US005178205A

United States Patent [19]

Fukase et al.

[11] Patent Number: 5,178,205

[45] Date of Patent: Jan. 12, 1993

[54] STRIP CASTING METHOD AND APPARATUS

[75] Inventors: Hisahiko Fukase, Wollongong; Walter Blejde, Balgownie; William J. Folder, Wollongong; Stephen B. Leabeater, Albion Park Rail; Joseph G. Herbertson, Newcastle, all of Australia

[73] Assignees: Ishikawajima-Harima Heavy Industries Co. Limited, Tokyo, Japan; John Lysaght (Australia) Limited, Sydney, Australia

[21] Appl. No.: 722,425

[22] Filed: Jun. 27, 1991

[30] Foreign Application Priority Data

Jul. 13, 1990 [AU] Australia ..... PK1162

[51] Int. Cl.[5] ..... B22D 11/10

[52] U.S. Cl. ..... 164/480; 164/428; 164/437; 222/594

[58] Field of Search ..... 164/428, 480, 437, 488, 164/134; 222/594, 606, 607

[56] References Cited

FOREIGN PATENT DOCUMENTS

| | | | |
|---|---|---|---|
| 57-103762 | 6/1982 | Japan | 164/488 |
| 63-183752 | 7/1988 | Japan | 164/437 |
| 2-34255 | 2/1990 | Japan | 164/428 |

*Primary Examiner*—Kuang Y. Lin

*Attorney, Agent, or Firm*—Nikaido, Marmelstein, Murray & Oram

[57] ABSTRACT

Method and apparatus for casting molten metal by passing molten metal form a casting pool above the nip of the pair of chilled rollers and thence through the pair of counter rotating chilled rollers, to thus form a thin sheet of solid metal. The molten metal is delivered to the casting pool from a metal delivery nozzle which contains an outlet flow passage at the bottom thereof, below the surface of the casting pool, through which the molten metal passes into the casting pool, which further contains a diffuser therein just above the outward flow passage, and which contains a pool of molten metal sufficiently deep that its surface is above the diffuser. The diffuser had a multiplicity of flow passages (holes) therein through which the molten metal, which is fed to the delivery nozzle, passes and is diffused into the outlet flow passage. An energy absorbing baffle means may be provided above the diffuser.

16 Claims, 4 Drawing Sheets

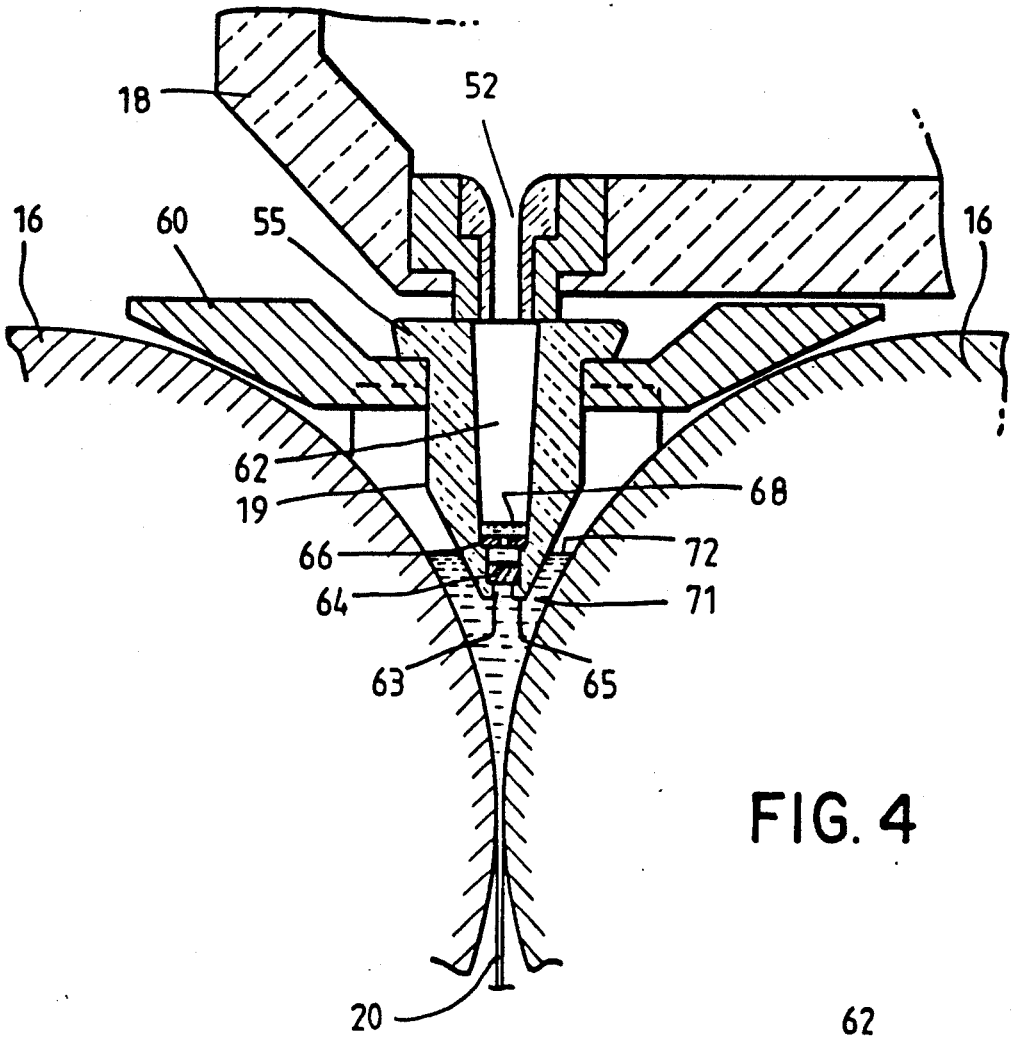
FIG. 4
FIG. 5
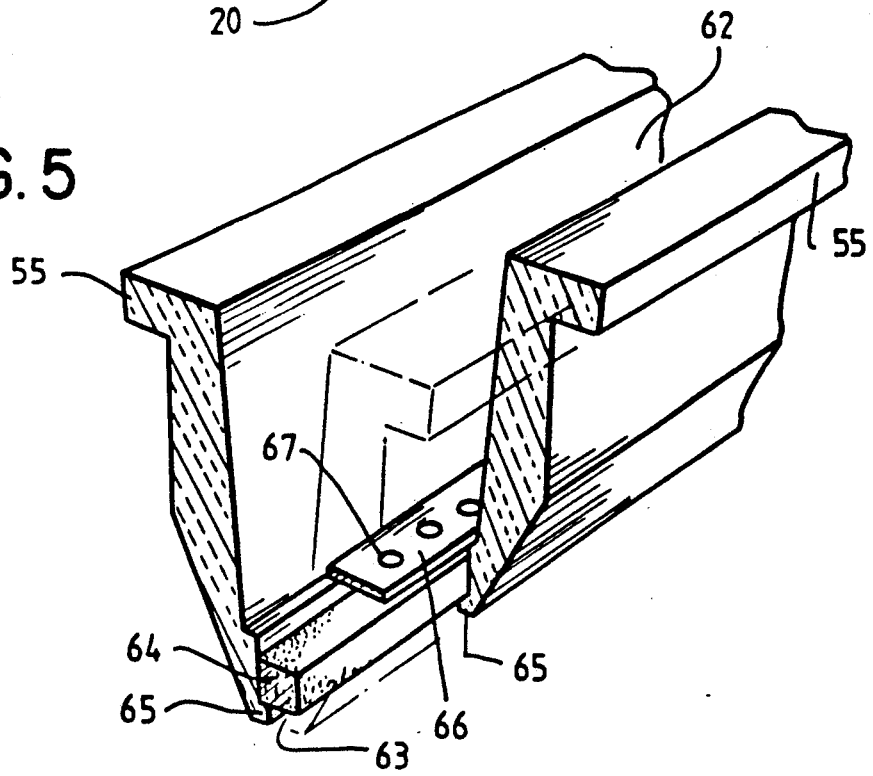

STRIP CASTING METHOD AND APPARATUS

TECHNICAL FIELD

This invention relates to the casting of metal strip. It has particular but not exclusive application to the casting of ferrous metal strip.

It is known to cast non-ferrous metals such as aluminium by continuous casting in a twin roll caster. Hot metal is introduced between a pair of contra-rotated horizontal casting rollers which are cooled so that metal shells solidify on the moving roller surfaces and are brought together at the nip between them to produce a solidified strip product at the outlet from the roller nip. The hot metal may be introduced into the nip between the rollers via a tundish and a metal delivery nozzle located beneath the tundish so as to receive a flow of metal from the tundish and to direct it into the nip between the rollers.

Although twin roll casting has been applied with some success to non-ferrous metals which solidify rapidly on cooling, there have been problems in applying the technique to the casting of ferrous metals. One particular problem has been the achievement of even cooling and solidification at the initial head end on commencement of a casting run to allow continuous casting to proceed. This problem is addressed by the invention disclosed in our co-pending Australian Patent Application No. PJ9458. It has also been found that when casting ferrous strip the importance of obtaining an even metal flow distribution across the width of the nip is particularly critical and defects can occur due to minor flow fluctuations. The present invention addresses this problem and provides an apparatus and technique whereby a very even flow distribution can be achieved. Although the invention has been developed to overcome a problem which is particularly critical in the casting of ferrous strip, it may also be applied to the casting of non-ferrous metals, for example aluminium.

DISCLOSURE OF THE INVENTION

According to the invention there is provided a method of casting metal strip of the kind in which molten metal is introduced between a pair of parallel casting rollers via a metal delivery nozzle disposed above the nip between the rollers to form a pool of molten metal above the nip between the rollers, wherein the delivery nozzle has an outlet passage fitted with a flow diffuser having a multiplicity of flow passages through which molten metal flows in passing through the outlet to the nip between the rollers, the outlet passage of the delivery nozzle extends below the surface of said pool of molten metal, and the molten metal is supplied to the outlet passage of the delivery nozzle so as to form a head of molten metal in the outlet passage to a height above the level of the surface of said pool and above the top of said diffuser so that there is a further pool of molten metal above the diffuser.

The flow diffuser may comprise a body of porous material.

Preferably, baffle means is positioned above the diffuser to absorb energy of metal flowing downwardly to the diffuser. The baffle means may conveniently be comprised of a baffle plate extending across the outlet passage and provided with a series of apertures spaced longitudinally of the nip between the casting rollers.

The invention also provides apparatus for casting metal strip, comprising a pair of parallel casting rollers forming a nip between them and a metal delivery nozzle for delivery of molten metal into the nip between the casting rollers, wherein the metal delivery nozzle has an outlet flow passage fitted with a flow diffuser having a multiplicity of flow passages through which hot metal will flow in passing through the outlet and baffle means is positioned above the diffuser so as to be effective in use of the appertures to absorb energy of metal flowing downwardly to the diffuser.

Preferably, the outlet passage has an elongate cross-section extending longitudinally of the nip between the casting rollers.

The outlet passage may be a single slot outlet passage terminating in a nozzle outlet slot extending substantially throughout the length of the nip between the casting rollers.

The flow diffuser may comprise a body of porous material. It may, for example, be comprised of a fibrous filter material having randomly oriented tortuous pores through which metal is constrained to flow in passing through said body.

The invention further provides a metal delivery nozzle for delivering molten metal to a nip between a pair of casting rollers, which delivery nozzle has an outlet passage fitted with a flow diffuser having a multiplicity of flow passage through which hot metal will flow in passing through the outlet passage and a baffle means to absorb energy of metal flowing in the outlet passage to the diffuser.

BRIEF DESCRIPTION OF THE DRAWINGS

In order that the invention may be more fully explained, one particular form of apparatus and its operation will be described in some detail with reference to the accompanying drawings in which:

FIG. 4 is an enlargement of part of FIG. 2; and

FIG. 5 is a broken away perspective view of the metal delivery nozzle.

BEST MODE OF CARRYING OUT THE INVENTION

Figure 1:
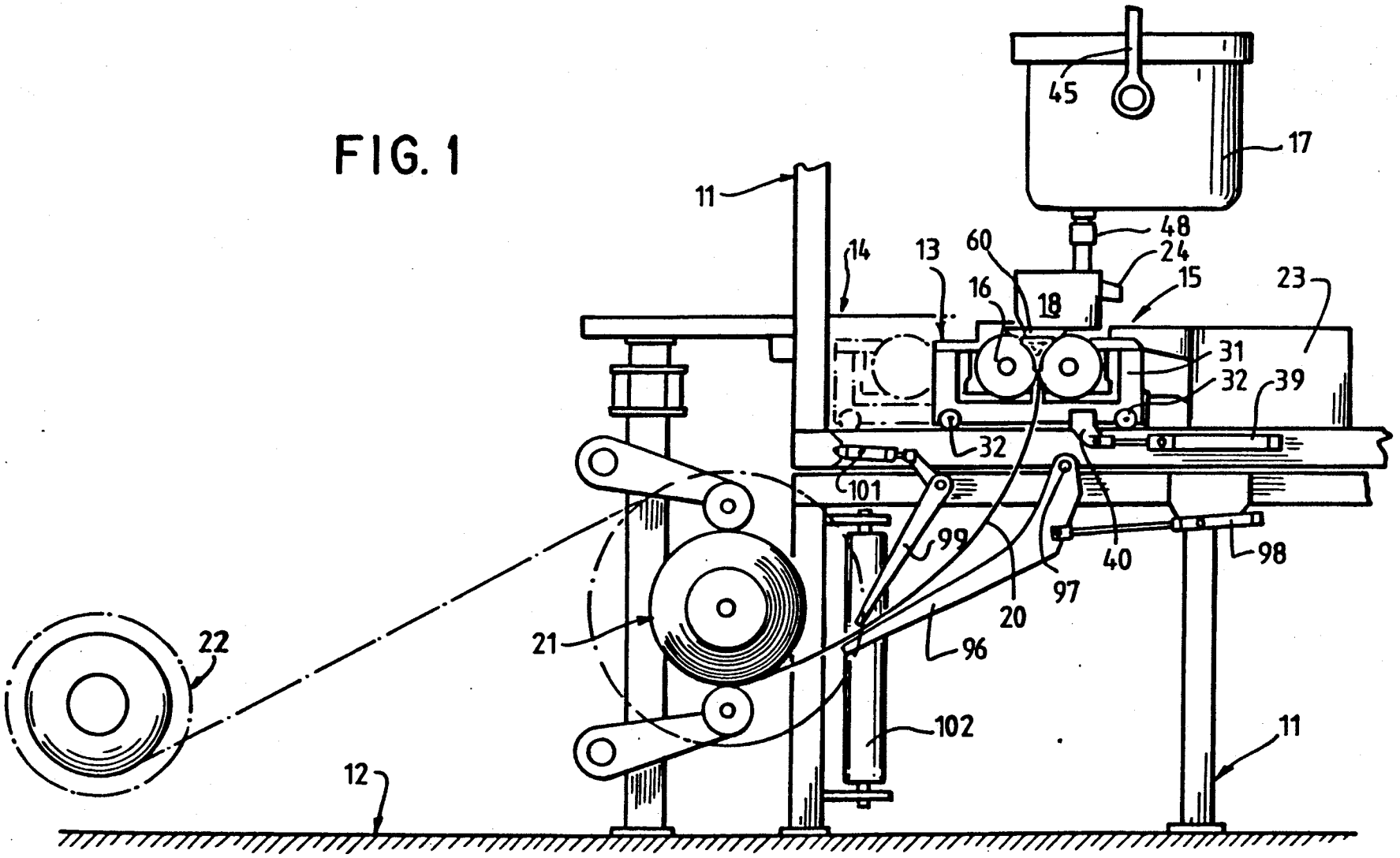
FIG. 1 illustrates a continuous strip caster incorporating apparatus constructed and operating in accordance with the present invention.
Figure 2:
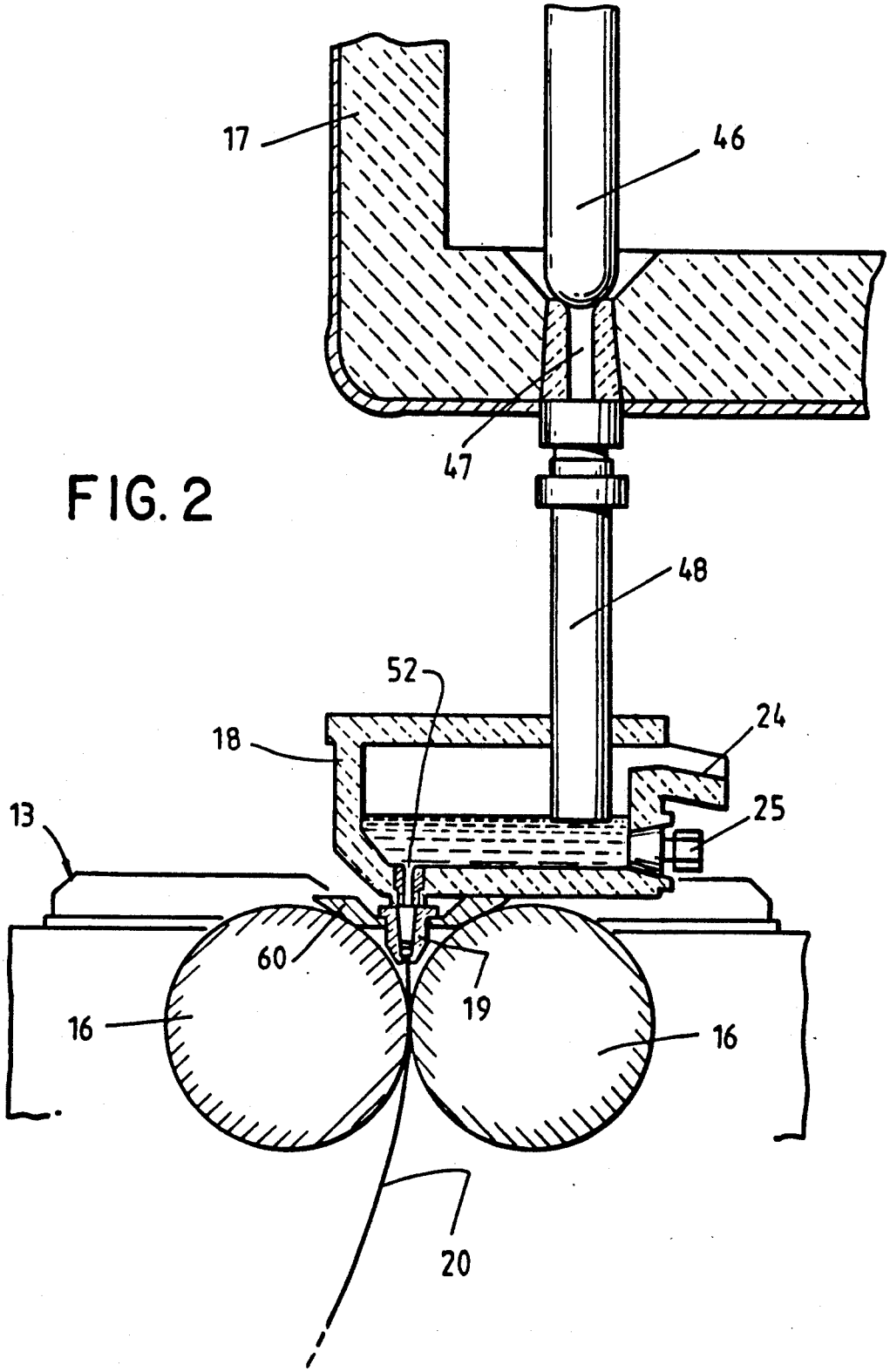
FIG. 2 is a vertical cross-section through important components of the caster illustrated in FIG. 1 including a metal delivery nozzle constructed in accordance with the invention.
Figure 3:
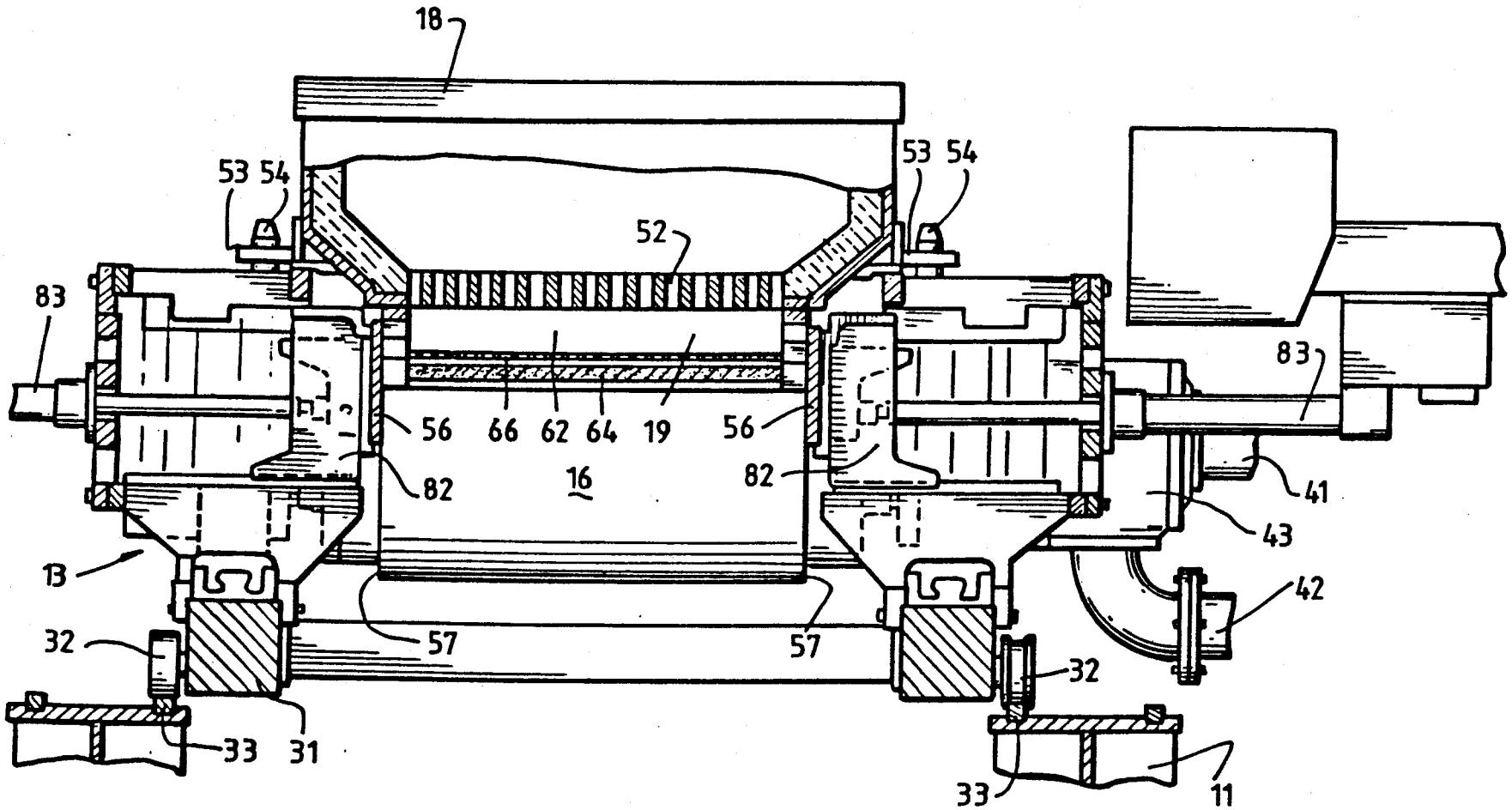
FIG. 3 is a further vertical cross-section through important components of the caster taken transverse to the section of FIG. 2.

The illustrated caster comprises a main machine frame 11 which stands up from the factory floor 12. Frame 11 supports a casting roller carriage 13 which is horizontally movable between an assembly station 14 and a casting station 15. Carriage 13 carries a pair of parallel casting rollers 16 to which molten metal is supplied during a casting operation from a ladle 17 via a tundish 18 and delivery nozzle 19. Casting rollers 16 are water cooled so that shells solidify on the moving roller surfaces and are brought together at the nip between them to produce a solidified strip product 20 at the roller outlet. This product is fed to a standard coiler 21 and may subsequently be transferred to a second coiler 22. A receptacle 23 is mounted on the machine frame adjacent the casting station and molten metal can be diverted into this receptacle via an overflow spout 24 on the tundish or by withdrawal of an emergency plug 25 at one side of the tundish if there is a severe malformation of product or other severe malfunction during a casting operation.

Roller carriage 13 comprises a carriage frame 31 mounted by wheels 32 on rails 33 extending along part of the main machine frame 11 whereby roller carriage 13 as a whole is mounted for movement along the rails 33. Carriage frame 31 carries a pair of roller cradles 34 in which the rollers 16 are rotatably mounted. Carriage 13 is movable along the rails 33 by actuation of a double acting hydraulic piston and cylinder unit 39, connected between a drive bracket 40 on the roller carriage and the main machine frame so as to be actuable to move the roller carriage between the assembly station 14 and casting station 15 and visa versa.

Casting rollers 16 are contra rotated through drive shafts 41 from an electric motor and transmission mounted on carriage frame 31. Rollers 16 have copper peripheral walls formed with a series of longitudinally extending and circumferentially spaced water cooling passages supplied with cooling water through the roller ends from water supply ducts in the roller drive shafts 41 which are connected to water supply hoses 42 through rotary glands 43. The rollers may typically be about 500 mm diameter and up to 1300 mm long in order to produce 1300 mm wide strip product.

Ladle 17 is of entirely conventional construction and is supported via a yoke 45 on an overhead crane whence it can be brought into position from a hot metal receiving station. The ladle is fitted with a stopper rod 46 actuable by a servo cylinder to allow molten metal to flow from the ladle through an outlet nozzle 47 and refractory shroud 48 into tundish 18.

Tundish 18 is also of conventional construction. It is formed as a wide dish made of a refractory material such as alumina graphite One side of the tundish receives molten metal from the ladle and is provided with the aforesaid overflow 24 and emergency plug 25. The other side of the tundish is provided with a series of longitudinally spaced metal outlet openings 52. The lower part of the tundish carries mounting brackets 53 for mounting the tundish onto the roller carriage frame 31 and provided with apertures to receive indexing pegs 54 on the carriage frame so as accurately to locate the tundish.

Delivery nozzle 19 is formed as an elongate body made of a refractory material such as alumina graphite. Its lower part is tapered so as to converge inwardly and downwardly so that it can project into the nip between casting rollers 16. A mounting bracket 60 is provided to support the nozzle on the roller carriage frame and the upper part of the nozzle is formed with outwardly projecting side flanges 55 which locate on the mounting bracket.

Delivery nozzle 19 has an internal vertically extending passage 62 to receive liquid flowing downwardly through the openings 52 of the tundish. Passage 62 converges toward its lower end part which serves as an outlet flow passage for flow of metal into the nip between the rollers 16. More specifically, the lower part of passage 62 terminates at an elongate outlet slot 63 at the bottom end of the delivery nozzle which slot extends longitudinally of the nip between the casting rollers.

In accordance with the present invention, the outlet passage of nozzle 19 is fitted with a flow diffuser 64 in the form of a body of porous filter material through which molten metal must flow in its passage to the outlet slot 63. This body of filter material may rest on inwardly projecting flanges 65 at the bottom end of the nozzle between which the slot outlet 63 is defined.

Immediately above diffuser 64, the outlet passage of delivery nozzle 19 is traversed by a baffle plate 66 perforated by a series of apertures 67. The holes 67 in the baffle plate may be staggered either longitudinally or transversely relative to the outlet holes of the tundish so that streams of metal falling from the outlet holes of the tundish are not aligned with the holes in the baffle plate. In a modification the outlet means from the tundish may be a continuous slot and the apertures in the baffle plate can then be displaced laterally of that slot.

During a casting run molten metal delivered from the delivery nozzle forms a pool 71 above the nip between the rollers, this pool being confined at the ends of the rollers by a pair of side closure plates 56 which are held against stepped ends 57 of the rollers by actuation of a pair of hydraulic cylinder units 83 fitted with closure plate holders 82. The upper surface 72 of pool 71, generally referred to as the "meniscus level" rises above the lower end of the delivery nozzle. Accordingly, the lower end of the delivery nozzle is immersed within this pool and the nozzle outlet passage extends below the surface of the pool or meniscus level. The flow of metal is also such as to produce a head of molten metal within the nozzle outlet passage to a height above the meniscus level 72. More particularly, the head of metal in the outlet passage extends above the top of diffuser body 64 so that there is formed a further pool of liquid metal 68 above that body. Preferably, the flow of metal is such that the upper surface 69 of the pool 68 is disposed slightly above baffle plate 66 so that the molten metal falling freely under gravity from the tundish falls into the pool 68 above the baffle plate rather than impinging directly on the baffle plate.

The baffle plate 66 absorbs energy from the falling stream of metal and it is the head of metal within the nozzle outlet passage extending above the meniscus level 72 which provides the dynamic head to force the metal through the diffuser body 64. The action of the diffuser is to further absorb kinetic energy of the metal flow and to spread the flow evenly throughout the length of the outlet 63 so as to produce a very even flow distribution across the width of the nip between the rollers. Thus, the nozzle is very effective to convert a high velocity relatively uneven stream falling from the tundish to a much slower constant velocity stream over the full width of the slot outlet 63.

The diffuser body 64 may conveniently be formed by alumina zirconium fibrous filter material. This material is commercially available having formerly been used for filtering purposes in foundry runners and tundish outlets for filtering solid impurities from steel. This material has randomly oriented tortuous pores through which the molten metal is forced to flow by the metal head within the outlet passage. The flow is thus caused to spread outwardly as it passes through the body to produce a relatively low velocity even flow at the outlet. It has been found that a material having about 10 pores per inch is particularly suited to the pouring of ferrous metal.

In a typical ferrous metal caster constructed in accordance with the invention, the width of the slot outlet from the nozzle may be in the range 3 mm to 30 mm, for example around 25 mm. The diffuser body 64 of filter material may be about 50 mm thickness in the vertical direction and the baffle plate 66 may typically be 10–15 mm above the diffuser body. The holes in the baffle plate may typically be about 10 mm diameter and arranged at about 50 mm spacing. During a casting run the head of metal formed in the nozzle outlet passage may typically be about 20 mm above the meniscus level 72.

The head end of strip 20 produced on initial pouring is guided by actuation of an apron table 96 to the jaws of coiler 21. Apron table 96 hangs from pivot mountings 97 on the main frame and can be swung toward the coiler by actuation of an hydraulic cylinder unit 98. Table 96 may operate against an upper strip guide flap 99 actuated by a piston and cylinder unit 101 and the strip may be confined between a pair of vertical side rollers 102. After the head end has been guided into the jaws of the coiler, the coiler is rotated to coil the product and the apron table is allowed to swing back to its inoperative position where it simply hangs from the machine frame clear of the product which is taken directly onto coiler 21. The resulting strip product may be subsequently transferred to coiler 22 to produce a final coil for transport away from the caster.

The above described apparatus and process has been advanced by way of example only and many variations are possible. For example, it would be possible to use a more porous and deeper diffuser body within the nozzle outlet passage so that the head of liquid within the outlet passage was formed entirely within the diffuser body. The head could still extend above the meniscus level to provide the dynamic head to force the liquid through the lower part of the filter body but the upper part of the filter body could be disposed above that head and serve as an appropriate baffle means to absorb energy of the falling stream of metal from the tundish. Moreover, it is not essential that the porous diffuser body be of a fibrous nature and other porous materials could be substituted. Suitable materials could be produced with pores formed by foaming, casting or extrusion techniques or by piercing pores in a blank body. It is accordingly to be understood that the invention is in no way limited to details of the above described apparatus and method and that many variations will fall within the scope of the appended claims.

We claim:

1. A method of casting metal strip in an apparatus comprising:

a pair of parallel casting rollers forming a nip therebetween;

a delivery nozzle means comprising a reservoir for molten metal disposed above said roller pair;

an outlet flow passage portion of said delivery nozzle means disposed between said reservoir and said nip comprising an outlet disposed proximate to said nip; and a diffuser comprising a multiplicity of flow passages therein adapted to allow the flow of hot metal therethrough from said reservoir to said outlet; said method comprising:

introducing molten metal into said reservoir at a rate such as to:

form a pool of molten metal in the nip of said roller pair to a height sufficient to cover said outlet;

form a head of molten metal in the outlet passage to a height above the level of the surface of said pool; and form a further pool of molten metal in said delivery nozzle means above the top of said diffuser.

2. A method as claimed in claim 1 including positioning baffle means above the diffuser to absorb energy of metal flowing downwardly to the diffuser.

3. A method as claimed in claim 2, wherein the baffle means comprises a baffle plate extending across the outlet passage which is provided with a series of apertures spaced longitudinally of the nip between the casting rollers.

4. A method as claimed in claim 1, wherein the flow diffuser comprises a body of porous material.

5. A method as claimed in claim 4, wherein said body is comprised of fibrous filter material having randomly oriented tortuous pores through which metal is constrained to flow in passing through said body.

6. Apparatus for casting metal strip, comprising a pair of parallel casting rollers forming a nip between them and a metal delivery nozzle for delivery of molten metal into the nip between the casting rollers, wherein the metal delivery nozzle has an outlet flow passage fitted with a flow diffuser having a multiplicity of flow passages through which hot metal will flow in passing through the outlet and baffle means is positioned above the diffuser so as to be effective in use of the apparatus to absorb energy of metal flowing downwardly to the diffuser.

7. Apparatus as claimed in claim 6, wherein the baffle means comprises a baffle plate extending across the outlet flow passage and provided with a series of apertures spaced longitudinally of the nip between the casting rollers.

8. Apparatus as claimed in claim 6, wherein the outlet passage has an elongate cross-section extending longitudinally of the nip between the casting rollers.

9. Apparatus as claimed in claim 8, wherein the outlet passage is a single slot outlet passage terminating in a nozzle outlet slot extending substantially throughout the length of the nip between the casting rollers.

10. Apparatus as claimed in claim 6, wherein the flow diffuser comprises a body of porous material

11. Apparatus as claimed in claim 10, wherein the flow diffuser comprises a body of fibrous filter material having randomly oriented tortuous pores through which metal will be constrained to flow in passing through said body.

12. A metal delivery nozzle means, for delivering molten metal to a nip between a pair of parallel casting rollers, comprising: an outlet passage, fitted with a flow diffuser having a multiplicity of flow passage means through which hot metal will flow in passing through the outlet passage disposed downstream of said diffuser directed toward said roller pair nip, and baffle means, adapted to absorb energy of metal flowing in the outlet passage to the diffuser, disposed upstream of said diffuser.

13. A metal delivery nozzle as claimed in claim 12, wherein the outlet passage has an elongate cross-section and the baffle means comprises a baffle plate, extending across the outlet passage, which is provided with a series of apertures spaced longitudinally of the elongate cross-section of that passage.

14. A metal delivery nozzle as claimed in claim 13, wherein the outlet passage is a single slot outlet passage terminating in a nozzle outlet slot.

15. A metal delivery nozzle as claimed in claim 12, wherein the flow diffuser comprises a body of porous material.

16. A metal delivery nozzle as claimed in claim 15 wherein the flow diffuser comprises a body of fibrous filter material having randomly oriented tortuous pores through which metal will be constrained to flow in passing through said body.

* * * * *